United States Patent [19]

Agatahama

[11] Patent Number: 4,553,118

[45] Date of Patent: Nov. 12, 1985

[54] POLARIZED ELECTROMAGNETIC DEVICE

[75] Inventor: Shunichi Agatahama, Osaka, Japan

[73] Assignee: Omron Tateisi Electronics Co., Kyoto, Japan

[21] Appl. No.: 384,051

[22] Filed: Jun. 1, 1982

[30] Foreign Application Priority Data

| | | | |
|---|---|---|---|
| Jun. 15, 1981 | [JP] | Japan | 56-92860 |
| Jun. 15, 1981 | [JP] | Japan | 56-92861 |
| Jun. 29, 1981 | [JP] | Japan | 56-101732 |

[51] Int. Cl.[4] ..... H01H 51/22

[52] U.S. Cl. ..... 335/79; 335/80; 335/128

[58] Field of Search ..... 335/78, 79, 80, 81, 335/85, 179, 180, 181, 230, 234, 128, 106, 203, 229

[56] References Cited

U.S. PATENT DOCUMENTS

| | | | |
|---|---|---|---|
| 2,866,927 | 12/1958 | Berg | 335/230 |
| 3,158,796 | 11/1964 | Musgrave | 335/230 |
| 3,234,345 | 2/1966 | Carpenter | 335/85 |
| 4,292,613 | 9/1981 | Bando | 335/128 |

*Primary Examiner*—E. A. Goldberg
*Assistant Examiner*—George Andrews
*Attorney, Agent, or Firm*—Cushman, Darby & Cushman

[57] ABSTRACT

Having a core wound with the magnetizing winding, and a yoke separated from the core, and an armature which has the permanent magnets, both pole pieces of the core and the facing-surfaces of the yoke being positioned apart in a predetermined space; in said space the magnetic poles of the permanent magnets being stationed; and through a joint-work of the magnetic flux created by the magnetizing winding and the armature flux created by the permanent magnets the armature is made to relatively reverse-displace against the core and the yoke.

4 Claims, 18 Drawing Figures

POLARIZED ELECTROMAGNETIC DEVICE

BRIEF SUMMARY OF THE INVENTION

The present invention relates to a polarized electromagnetic device used for electromagnetic relays and other devices.

Recently, a quite sizable increase of production is done for polarized relays solely used for print boards as small and thin as semi-conductor element like IC. Since it is preferable to activate this type of polarized relay in the semi-conductor circuit directly by a transistor, it is required to keep the electric consumption of the winding and the exciting current to a minimal level.

As is known, the polarized relay only requires less current for activation as compared with other types of electromagnetic relays and shows its characteristic of high sensitivity. According to the current technological trend, however, there is a growing demand to have more compact, thinner, higher sensitive, more dependable and inexpensive polarized relays than the conventional ones.

It is rather difficult for the conventional type of polarized relay to satisfy such growing demand for more miniaturization and higher sensitivity. The reason for such difficulty lies in the configuration of the magnetic circuit in the polarized electromagnetic device used for conventional polarized relays. In the conventional polarized electromagnetic device, the member of the component materials used for magnetic circuit are generally too complex to be made compact and thin. There are some relays having magnetic circuits which are especially compact and thin.

But in such cases, the sensitivity, the dependability and the stability are sacrificed. In order to supply the device at an inexpensive cost, wherein it is important that parts are produced easily, and that automated or semi-automated assembly is made possible, the conventional polarized electromagnetic devices have not shown satisfactory productivity due to the configuration of their magnetic circuits.

This invention is made, having considered such weaknesses of the conventional devices.

The object of the present invention is to supply a polarized electromagnetic device with a new type of magnetic circuit, which is easily made compact and thin, and yet at the same time gives stable activity.

The further object of the present invention is to supply a polarized electromagnetic device with a simple and easily manufactured configuration of the magnetic circuit.

The still further object of the present invention is to supply a polarized electromagnetic device with a simple layout in the plurality of parts consisting the magnetic circuit and with considerably easy assemblage.

Another object of the present invention is to supply a polarized electromagnetic device which effectively utilizes the core of the permanent magnet and thus maintains the strength in a stable condition, and yet remains sensitive enough to secure the reverse motion with a minimal exciting current.

A still further object of the present invention is to supply a polarized electromagnetic device which secures the stable forward motion and reverse motion where the rotation stroke of an armature is very slight.

Further objects of this invention will become obvious upon an understanding of the illustrative embodiments about to be described or will be indicated in the apended claims, and various advantages not referred to herein will occur to one skilled in the art upon employment of the invention in practice.

Figure 3:
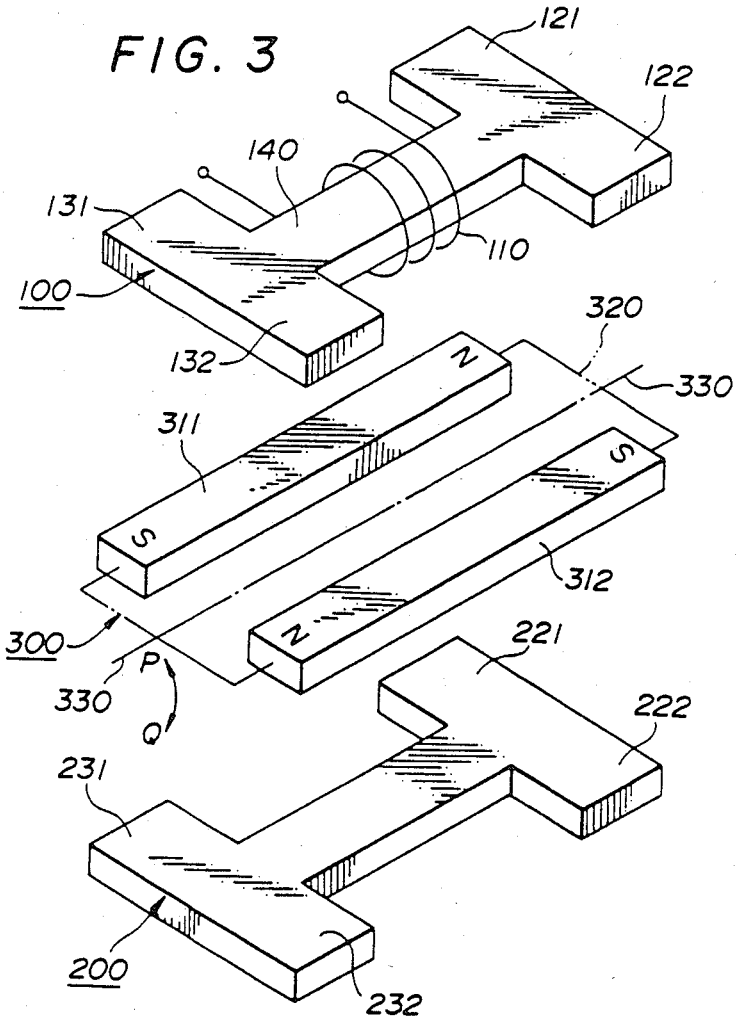
Figure 4:
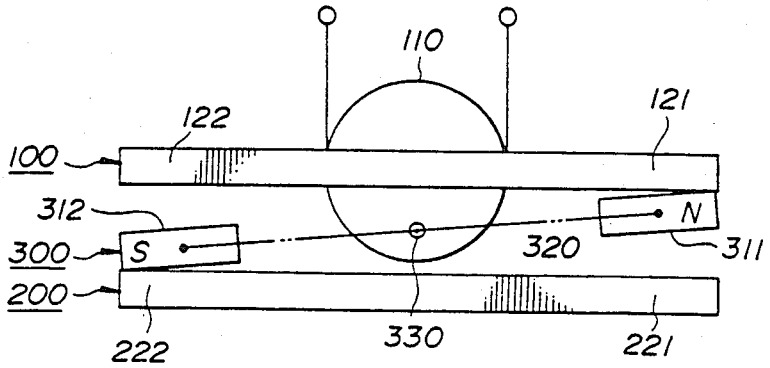
Figure 5:
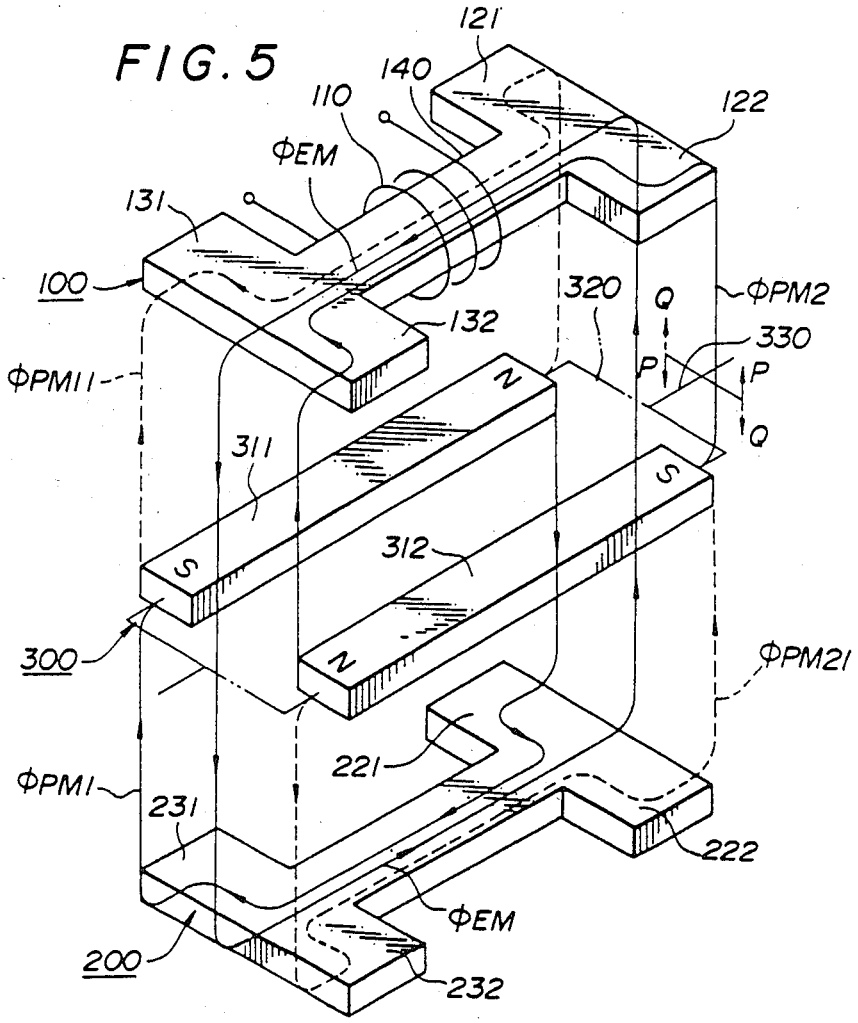
Figure 6:
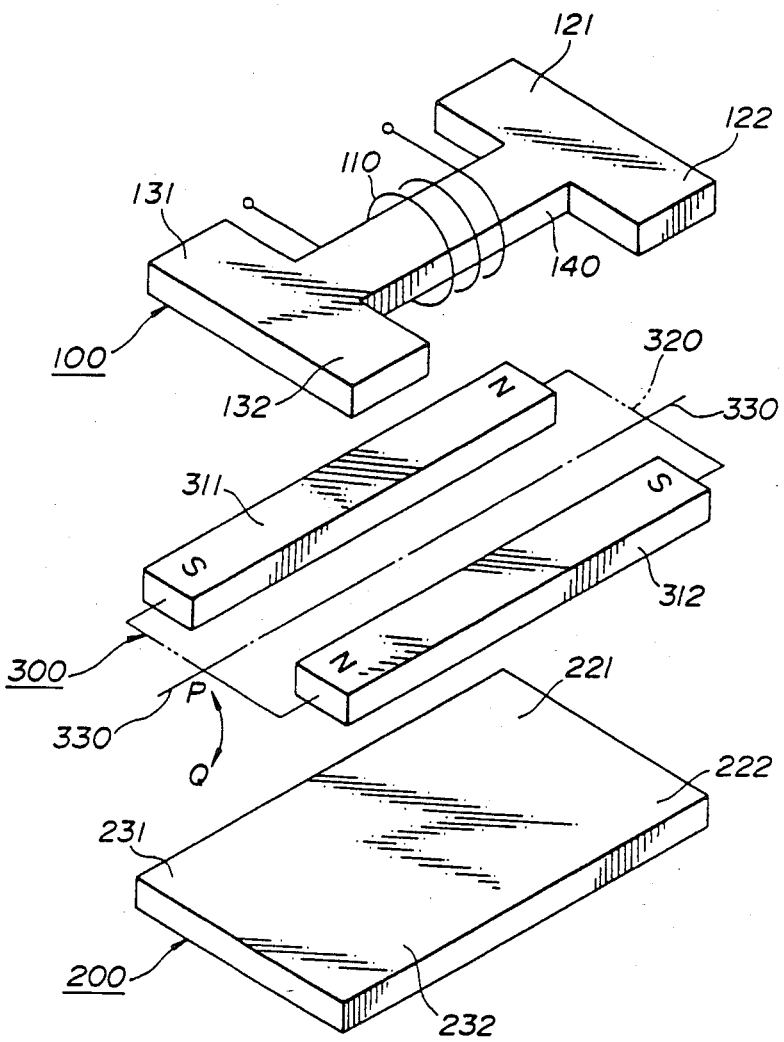
Figure 7:
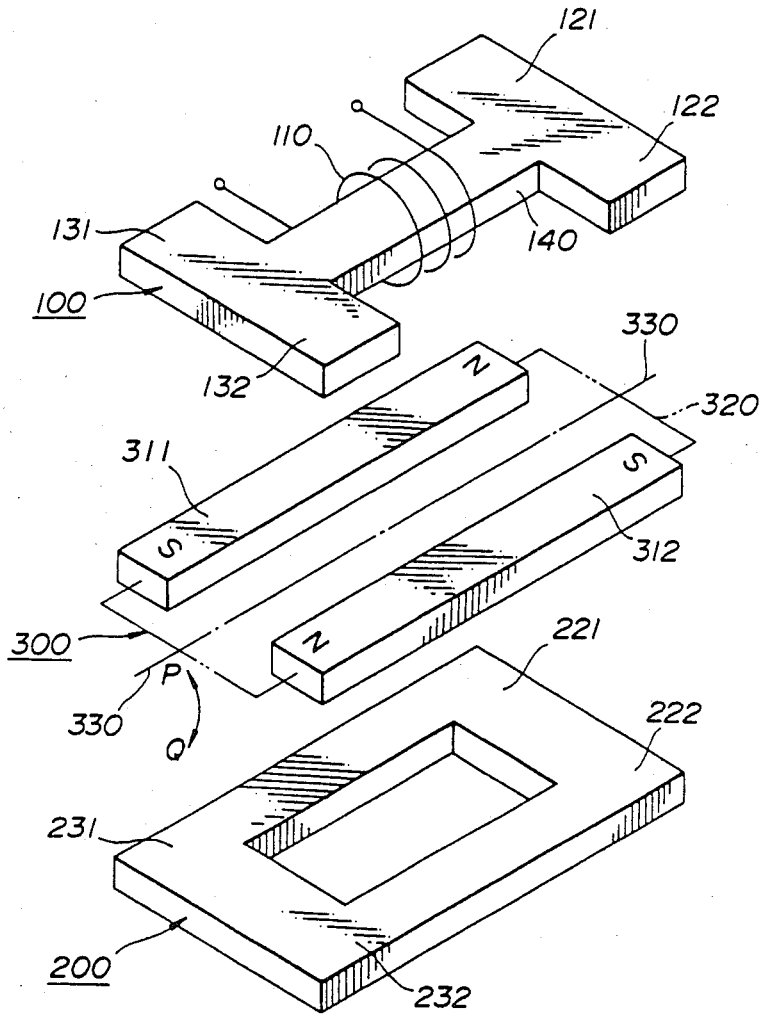
Figure 8:
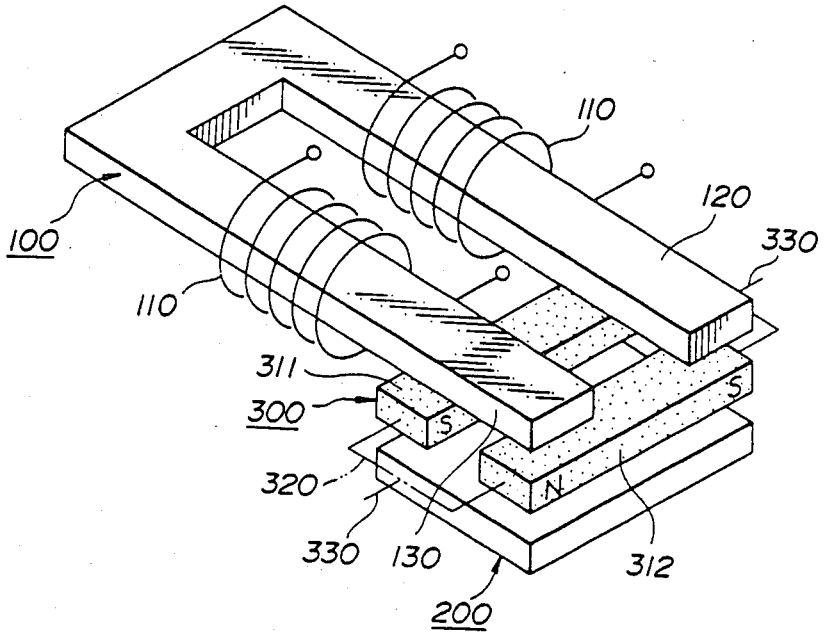
Figure 11:
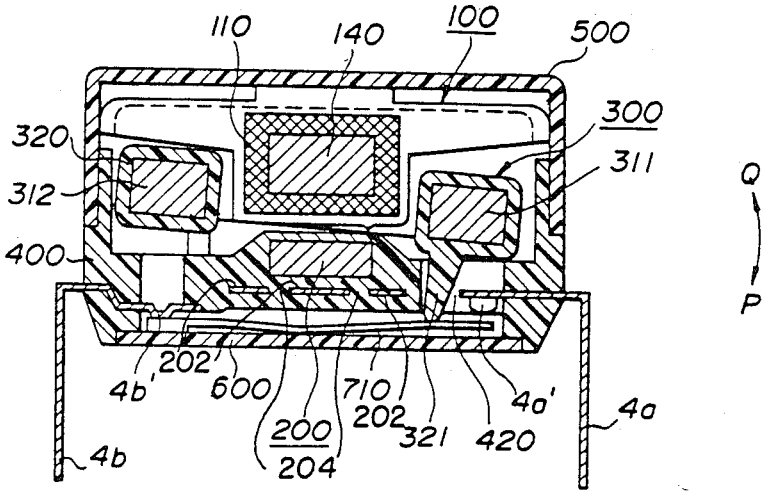
Figure 9:
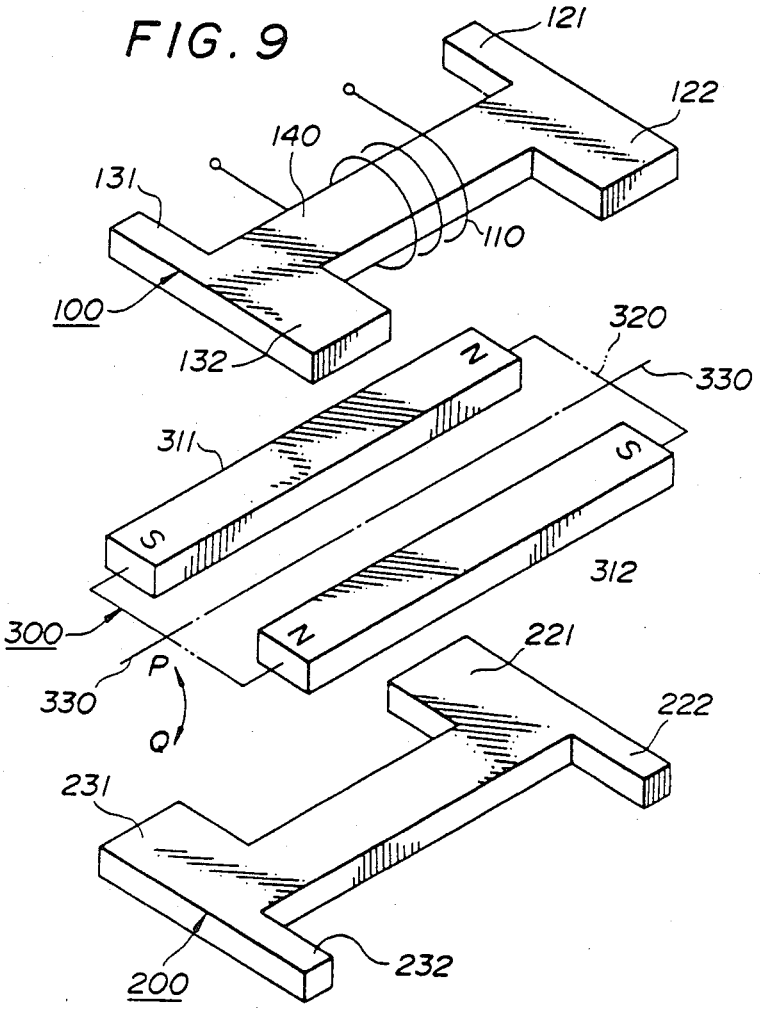
Figure 10:
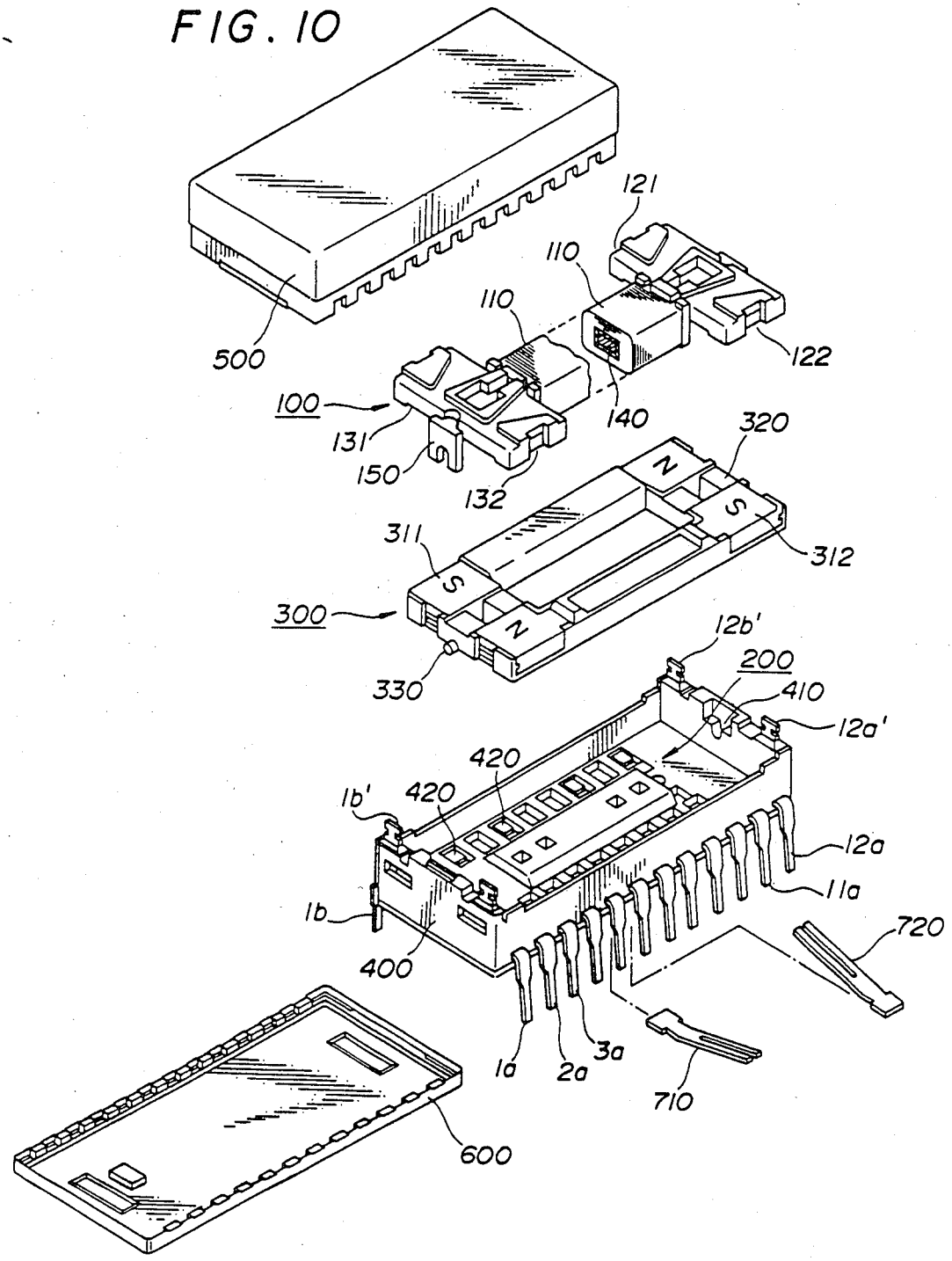
Figure 12:
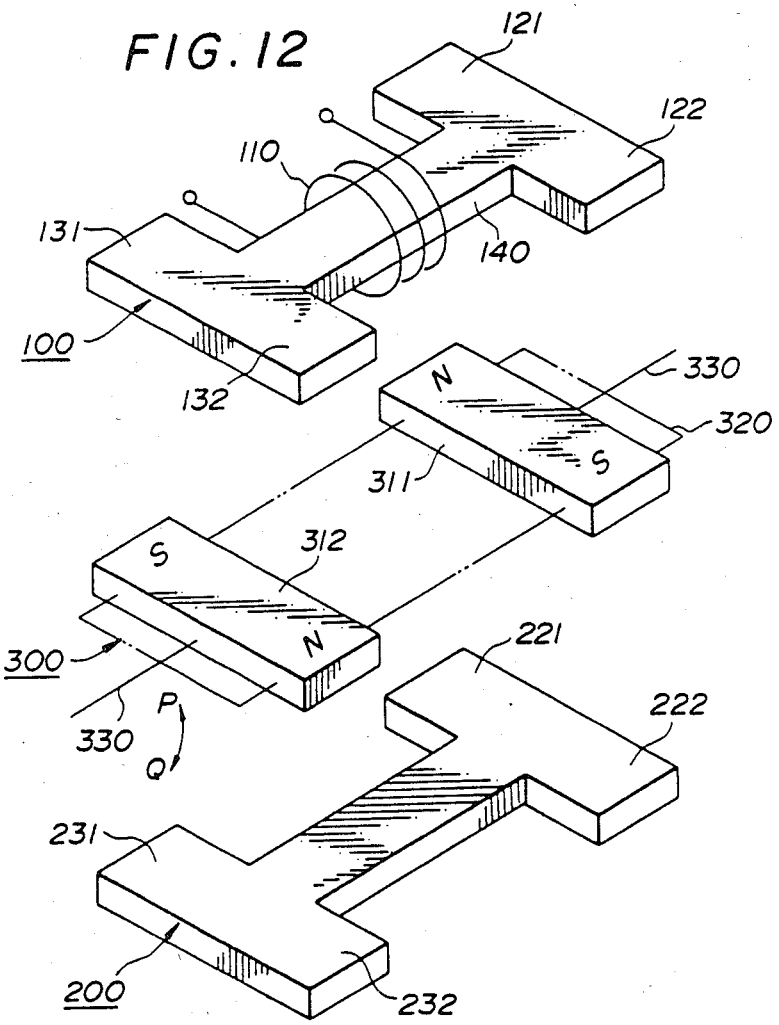
Figure 13:
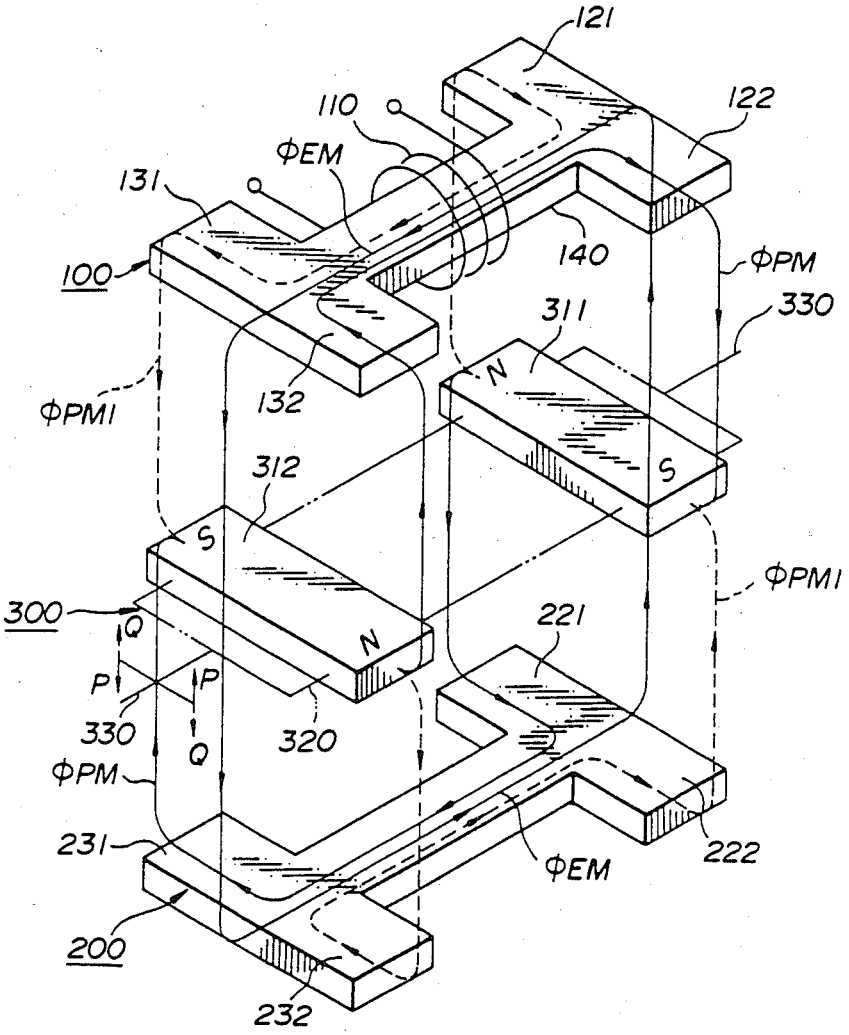
Figure 14:
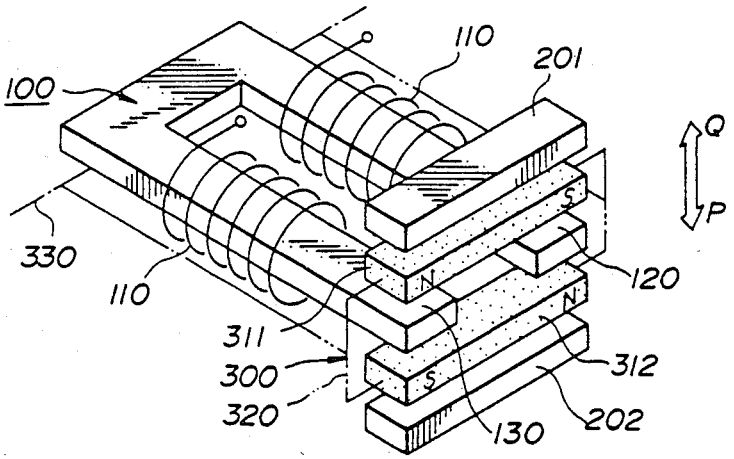
Figure 15:
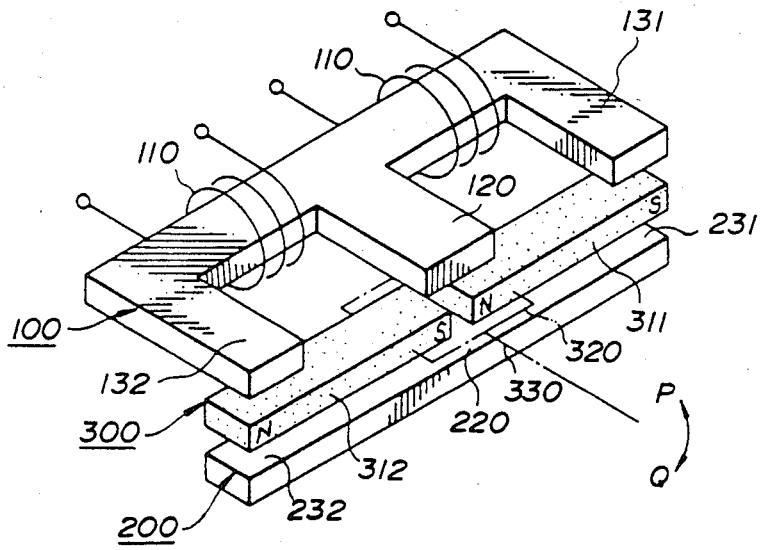

FIG. *2a* through FIG. *2d* are the schematic illustrations showing the magnetic circuit movement of the polarized electromagnetic device of said first embodiment;

FIG. 3 is a disassembled perspective view showing the polarized electromagnetic device of the second embodiment of the present invention;

FIG. 4 is a front assembled view showing the polarized electromagnetic device of said second embodiment;

FIG. 5 is a schematic illustration of the magnetic circuit of the polarized electromagnetic device showing said second embodiment;

FIG. 6 is a disassembled perspective view showing the polarized electromagnetic device in the third embodiment of the present invention;

FIG. 7 is a disassembled perspective view showing the polarized electromagnetic device in the fourth embodiment of the present invention;

FIG. 8 is a perspective view showing the polarized electromagnetic device in the fifth embodiment of the present invention;

FIG. 9 is a disassembled perspective view showing the polarized electromagnetic device in the sixth embodiment of the present invention;

FIG. 10 is a disassembled perspective view showing the polarized relay comprised by the polarized electromagnetic device of said second embodiment;

FIG. 11 is an assembled sectional view showing the polarized relay in FIG. 10;

FIG. 12 is a disassembled perspective view showing the polarized electromagnetic device in the seventh embodiment of the present invention;

FIG. 13 is a schematic illustration showing the magnetic circuit of the polarized electromagnetic device of said seventh embodiment;

FIG. 14 is a perspective view showing the polarized electromagnetic device in the eighth embodiment of the present invention;

FIG. 15 is a perspective view showing the polarized electromagnetic device in the ninth embodiment of the present invention.

DETAILED DESCRIPTION OF THE INVENTION

Figure 1:
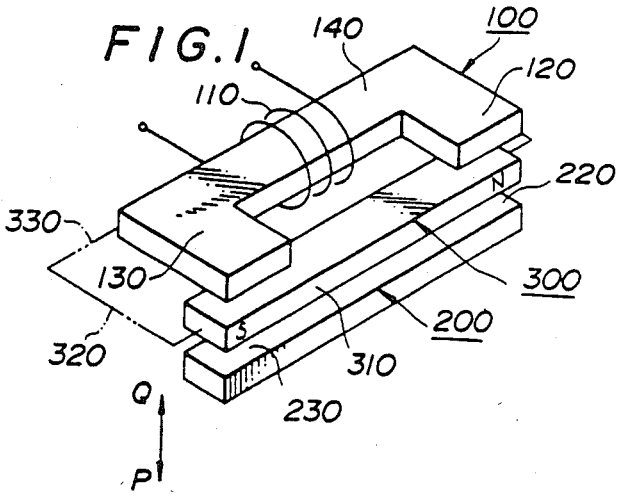
FIG. 1 is a perspective view of the first embodiment showing the polarized electromagnetic device of the present invention.
Figure 2A:
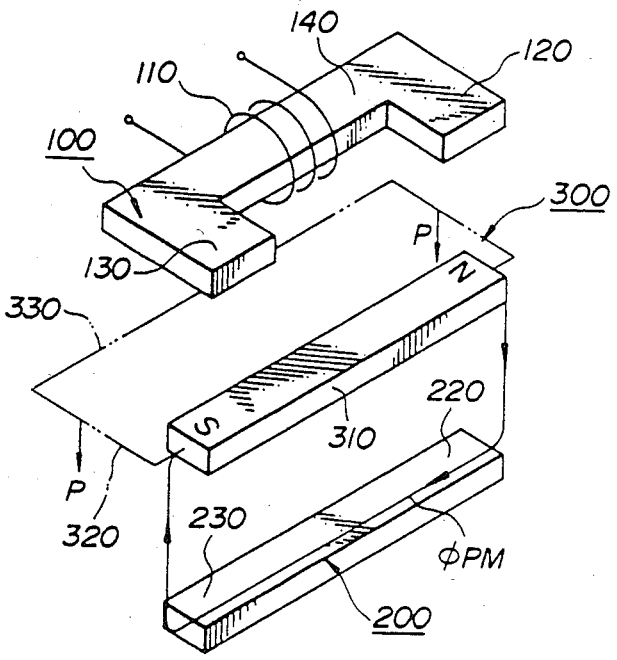
Figure 2B:
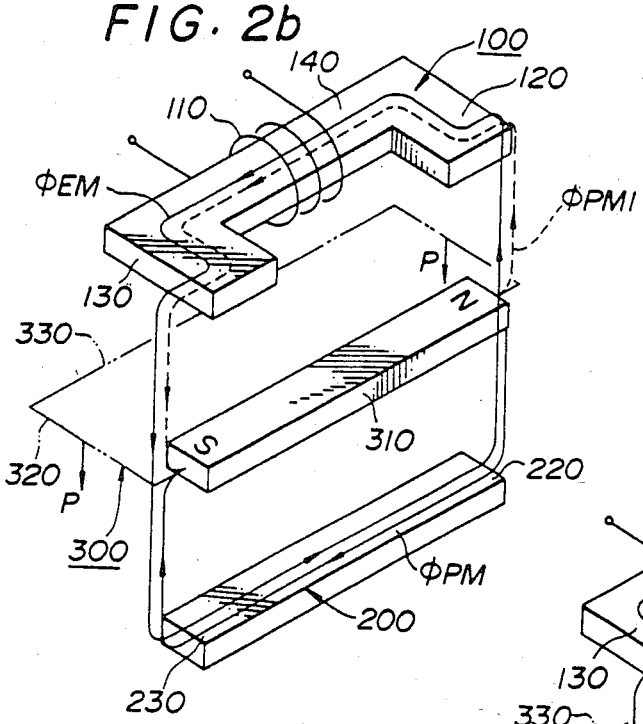
Figure 2C:
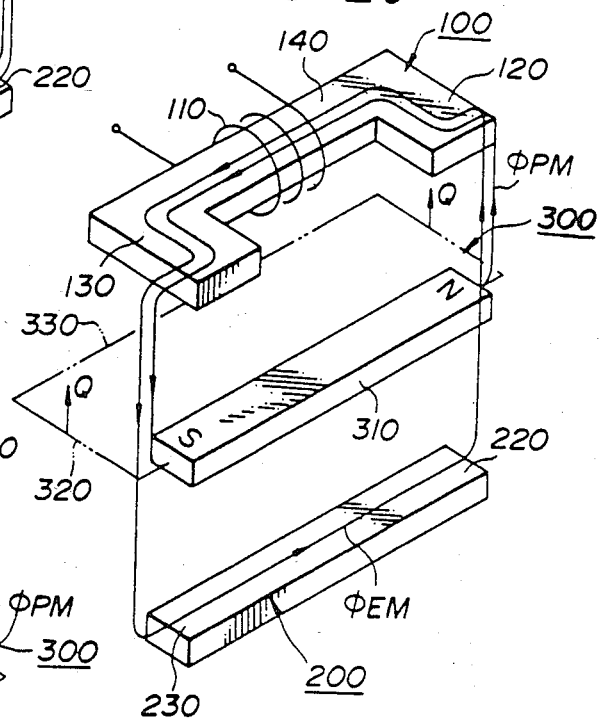
Figure 2D:
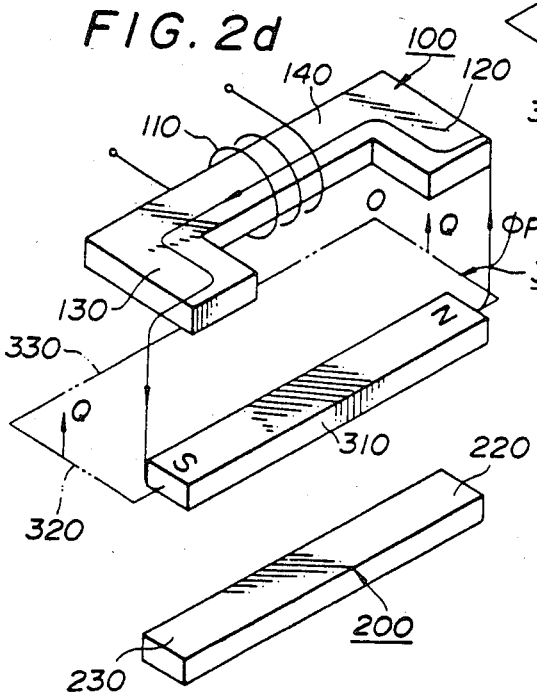

FIG. 1 is a configuration of the embodiment (hereinafter called "first embodiment") of the basic construction of the polarized electromagnetic device of the present invention.

The polarized electromagnetic device in FIG. 1 is comprised with core 100 wound with magnetizing winding 110 and includes a yoke 200 which defines the closed magnetic circuit by the magnetic flux created by said magnetizing winding 110 in the configuration. The yoke is separated and has the facing-surfaces 220, 230 positioned in space-apart relationship to the pole pieces 120, 130 of said core, and makes the magnetic contact with said core through said space (air gap) thereby. The device also includes an armature 300 which has a permanent magnet 310, of which both magnetic poles N, S are positioned in said air gap, and is so positioned as to be able to have the two-way displacement between the pole pieces 120, 130 of said core and the facing-surfaces 220, 230 of said yoke 200.

The core 100 is composed of a flat letter-U or letter C shaped board type soft-magnetic member. The central, base 140 of the core 100 is wound with the magnetizing winding 110, and at its both ends has the pole pieces 120, 130.

The component materials of yoke 200 is the same board type soft magnetic material as the core 100 and is made in a flat rod form.

Said core 100 and yoke 200 are fixed in a case, undescribed herein.

The pole pieces 120, 130 and the facing-surfaces 220, 230 at both ends of the yoke 200 are correspondingly positioned in spaced-apart relationship. Permanent magnet 310 is made in a flat and rod form similar the yoke 200.

Both ends of magnet 310 are magnetized in S and N. This permanent magnet 310 is unitarily constructed with the non-magnetic stator 320 which is made of synthetic resins. Though this stator 320 is illustrated only by the skip-dotted line, the armature 300 composed with the stator 320 and the permanent magnet 310 defines a the flat board-like shape as a whole.

The armature 300 is situated between the core 100 and the yoke 200, and is also fixed in the case unillustrated herein as to being able to secure free rotation around axis 330.

Axis 330 is parallel to the permanent magnet 310. Thus, since the armature 300 is fixed so as to permit free rotation, indicated by arrow P-Q, around the axis 330, the permanent magnet 310 can assume two-way displacement in two stabilized states, either in the contact position with the pole pieces 120, 130 of the core 100 or in the other contact position with the facing-surfaces 220, 230 of the yoke 200.

The following explanation is given as to the polarized electromagnetic device which is composed according to the configuration briefly described above.

FIG. *2a* through FIG. *2d* are the schematic illustrations of the polarized electromagnetic device as described in FIG. 1.

FIG. *2a* shows the state of the magnetic circuit wherein the armature 300 rotates toward the direction indicated by arrow P, and the permanent magnet 310 is in the contact position with the yoke 200 side, and thus no exciting current is supplied to the magnetizing winding 110, e.g. in non-excited condition.

In this state, the magnetic flux $\phi$PM by the permanent magnet 310 runs through the yoke 200 from the facing-surface 220 side to the facing-surface 230 side, thus to create the closed magnetic circuit.

In this state, the exciting current is so applied to the magnetizing winding 110 in a designated direction that the pole piece 120 side becomes S and the pole piece 130 side becomes N.

Then, as described in FIG. *2b*, the magnetic flux $\phi$EM created by the magnetizing winding 110 flows from the pole piece 130 to the facing-surface 230 of the yoke 200 to the yoke 200 to the facing-surface 220 of the yoke 200 to the pole piece 120, thus the closed magnetic circuit is created. In this sequence, the magnetic flux $\phi$PM at the yoke 200 created by the permanent magnet 310 and the magnetic flux $\phi$EM at the yoke 200 created by the magnetizing winding 110 are in opposite directions.

Due to this, the magnetic flux $\phi$PM flowing through the yoke 200 is cancelled by the magnetic flux $\phi$EM. Namely, the magnetic impendance of the closed magnetic circuit drastically increases when the magnetic flux $\phi$PM at the permanent magnet 310 runs through the yoke 200 due to the created magnetic flux $\phi$EM.

On the other hand, a part of the magnetic flux, created by the permanent magnet 310 as indicated by the dotted line $\phi$PM1 in the figure, forms the closed magnetic circuit with the flow in the sequence from the N pole piece 120 of the core 100 to the core 100 to the pole piece 130 of the core 100 to the S pole.

The direction of this closed magnetic circuit is the same as that of the magnetic flux $\phi$EM created at the magnetizing winding 110.

As a result of the sequences, provided that the magnetic flat $\phi$EM created at the magnetizing winding 110 exceeds the designated level of the magnetic flux density, the attracting powers of the magnetic flux $\phi$EM and the magnetic flux $\phi$PM1, being in the same direction, overcomes the attracting power of the magnetic flux $\phi$PM, cancelled by the magnetic flux $\phi$EM, and the armature 300 will rotate in the direction of arrow Q around the axis 330. When the permanent magnet 310 disengages from the yoke 200 even slightly, the magnetic impedance of the closed magnetic circuit of the magnetic flux $\phi$PM which flows through the yoke 200 is drastically increased. Therefore, the armature 300 rotates instantly in the arrow Q direction and the permanent magnet 310 makes contact with the pole pieces 120, 130 of the core 100.

As described above, when the armature 300 rotates in arrow Q direction, as shown in FIG. *2c*, the magnetic flux $\phi$PM created at the permanent magnet 310 flows through the core 100 and becomes absolutely in conformity with the magnetic flux $\phi$EM created at the winding 110. In this condition, as FIG. *2d* shows, the armature flux $\phi$PM of the permanent magnet 310 keeps forming the closed magnetic circuit by flowing through the core 100 and the permanent magnet 310 and the core 100 stay in make-contact even when the non-exciting state is created by cutting the exciting current to the winding 110.

In order to have the armature 300 reverse rotation in the arrow P direction from the state shown in FIG. *2d* to the state shown in FIG. *2a*, it suffices to excite the winding 110 by a reverse-direction current against the above description, and thus, to create the reverse-direction magnetic flux against the above description. The reverse-rotation in that case as in accordance with the configuration of the magnetic circuit is simply to take the reverse direction of the movement as described above, and all the sequences are as same as the movement described above. Therefore, with respect to the sequence, the explanation is herein abbreviated.

In FIG. 1 device, the yoke 200 can be made into the same form as the core 100. In that case, the core 100 and the yoke 200 become identically constructed, so that they can be produced inexpensively by a press puncher.

The FIG. 1 device is a dual-stability type device where the armature 300 can take either one of two stable states in the non-magnetized condition when the winding 110 is not excited. On the other hand, it is possible to create a single-stability type polarized electromagnetic device with the same magnetic circuit configuration as the above described. In that case, for instance, the armature 300 is to be constantly biased in one direction by means of a spring or others. Or, the armature 300 is to be biased by creating an appreciable difference between the attracting power toward the core 100 side and the attracting power toward the yoke 200 side of the permanent magnet 310. This has the bearing to other embodiments the following explanations.

The above described movement is also applicable to the armature 300, when the armature 300 is so positioned as to make two-way movement on a straight line.

Still further in the above described embodiment, wherein the core 100 and the yoke 200 are fired while the armature 300 remains movable, it suffices to realize the correlative movements among these three components, so that it is possible that the armature 300 is fixed and a component is made movable on which the core 100 and the yoke 200 are connected by a non-magnetic material. This fact has the bearing to other embodiments illustrated in the following.

The explanations above represent the basic configuration and its schematic logic of the polarized electromagnetic device of the present invention.

The following are given the explanations as to other embodiments of the polarized electromagnetic device of the present invention.

FIG. 3 through FIG. 5 show the second embodiments of the polarized electromagnetic device of the present invention. This device is basically as same as the preceding embodiment, comprised with the core 100 wound with a winding 110, a separated yoke 200 from the core 100 and an armature 300. In this device of the second embodiment, there are two permanent magnets 311, 312 involved in the armature 300, and these two permanent magnets 311, 312 work to each other jointly.

In the second embodiment shown in FIG. 3, the core 100 is made to form a flat letter-H shape, and its central, base 140 is wound with core the winding 110, and at the both ends of the base 140 there are two pole pieces 121, 122, 131, 132 at each end. As apparent from the figure, the pole pieces 121 and 122 show the same pole and the pole pieces 131 and 132 show the opposite pole with said pole in the magnetic field created by the winding 110.

The yoke 200 is made in the exactly same letter-H shape, the counterparts of the pole pieces 121, 122, 131, 132 of the core 100 are the facing-surfaces 221, 222, 231, 232. The core 100 and the yoke 200 are fixed in the case, herein undescribed, in the construction that each said pole piece and each said facing-surface are so positioned correspondingly spaced-apart.

The armature 300 is composed as one unit by the stator 320 made of the non-magnetic materials which holds the two flat, rod shaped permanent magnets 311 and 312, and is constructed as a flat and board-like component as a whole. The armature 300 is positioned between the core 100 and the yoke 200 and so fixed in the case, herein undescribed, as to secure the free rotation in arrow P-Q directions around the axis 330. Central pivot axis 330 is positioned in the center of the armature 300 and is parallel to the central line of the base 140 of the core 100.

Two permanent magnets 311 and 312 of the armature 300 are in parallel with the rotation central axis 330 and are positioned symmetrically against the shaft 330. The directions of the magnetic poles of these two permanent magnets 311 and 312 are opposite to each other, and both poles of the permanent magnet 311 correspond to the pole pieces 121 and 131, as each in the opposite magnetic pole to the other, of the core 100. Similarly, both poles of the permanent magnet 312 correspond to the pole pieces 122 and 132, each being the opposite magnetic pole to the other of the core 100.

Next, the schematic movement of the device of the second embodiment, configurated as aforedescribed, is explained accordingly with FIG. 5.

As the initial condition, it is presumed that the armature 300 stably rotates in arrow P direction, and one of the permanent magnet 311 is in contact with the yoke 200 and the other permanent magnet 312 is in contact with the core 100 and the winding 110 is completely unexcited. In this state, the magnetic flux created by one permanent magnet 311, as indicated by the solid line $\phi$PM1 in the figure, runs through the yoke 200 from the facing-surface 221 side to the facing-surface 231 side, and thus forms the closed magnetic circuit. And, the magnetic flux created by the other permanent magnet 312, as indicated by the solid line $\phi$PM2 in the figure, runs through the core 100 from the pole 132 side to the pole piece 131 side, and thus forms the closed magnetic circuit.

In the above condition, when the winding is excited by the current in the designated direction, the magnetic flux $\phi$EM is created which forms the closed magnetic circuit by running through the core 100 and the yoke 200 in the designated direction. The direction of the magnetic flux $\phi$EM in this state as shown in FIG. 5, is the direction from the pole pieces 131, 132 to the facing-surfaces 231, 232 of the yoke 200 to the yoke 200 to the facing-surfaces 221, 222 of the yoke 200 to the pole pieces 121, 122 of the core 100. Then, the magnetic flux $\phi$EM created by the winding 110 becomes opposite at the core 100 and the yoke 200 to the magnetic fluxes $\phi$PM1, $\phi$PM2 created by the two permanent magnets 311, 312, and cancels these magnetic fluxes $\phi$PM1, $\phi$PM2. And at the same time, as indicated by the dotted line, the magnetic flux $\phi$PM11, created by the permanent magnet 311, running through the core 100, and the magnetic flux $\phi$PM21, created by the permanent magnet 312, running through the yoke 200, become the same direction with the magnetic flux $\phi$EM, created by the winding 110 and these magnetic fluxes work toward each other jointly.

Therefore, in a similar manner as the first embodiment explained herein before, one permanent magnet 311 disengages from the yoke 200 and is attracted toward the direction of contact with the core 100 side, while the other permanent magnet 312 disengages from the core 100 and is attracted toward the yoke 200 side. As the result, the armature 300 instantly rotates in arrow Q direction and is stabilized, when the permanent magnet 311 makes contact with the core 100 and the permanent magnet 312 makes the contact with the yoke 200. This stabilized state remains maintained by the magnetic strength of the permanent magnets 311 and 312, even when the exciting current to the winding 110 is cut off. In this state, if the winding 110 is excited by the current in the reverse direction against the aforementioned direction, the armature 300 makes the reverse rotation in arrow P direction by the influence of the reverse movement against the aforementioned description.

In said second embodiment, due to the fact that the magnetic strength of two permanent magnets 311 and 312 work jointly for the armature 300 rotating, even when a smaller device is configurated with adopting smaller permanent magnets, the holding strength of the armature is well maintained, and the sensitivity for the rotation can be maintained in an appreciable level. And as the armature has an ample level of the holding strength, even when the rotation stroke is made very minimal, the sure and clear rotation movement is secured. This characteristic enables the whole composition of this device to be made thinner. And these characteristics are applicable to other following embodiments.

The third embodiment of the present invention, shown in FIG. 6, makes the form of the yoke 200 in the second embodiment into a rectangular shape.

The fourth embodiment of the present invention, shown in FIG. 7, has the form of the yoke 200 in the second embodiment as a flat, rectangular ring.

The fifth embodiment of the present invention, shown in FIG. 8, has the form of the core 100 in the third embodiment made into a letter-U shape.

The sixth embodiment of the present invention, shown in FIG. 9, shows the modification made on the device in the second embodiment into single-stable-type unit. In this sixth embodiment, the pole pieces 121 and 131 of the core 100 are made compact and the facing-surfaces 222 and 232 of the yoke 200 are also made compact. As the result, when any other powers are not applied to the armature 300, one permanent magnet 311 is attracted to the facing-surfaces 221 and 231 of the yoke 200 side than to the pole pieces 121 and 131 of the core 100 side, and the other permanent magnet 312 is attracted to the facing-surfaces 222 and 232 side than to the pole pieces 122 and 132 of the core 100 side. Therefore, when the winding 100 is not excited, the armature 300 rotates constantly in arrow P direction and remains stabilized.

Thus, by imparting the incompatibility in the magnetic attracting strength to the core 100 side and to the yoke 200 side, the single-stable-type polarized electromagnetic device can be configurated. It is easy to find other means that the one illustrated in the sixth embodiment in FIG. 9 to impart the incompatibility in the magnetic attracting strength.

FIG. 10 is a disassembled perspective illustration of the polarized relay comprised with the polarized electromagnetic device in said second embodiment, and FIG. 11 is an assembled sectional drawing of the same polarized relay. This polarized relay is placed in the dual-in-line package. This package is comprised with the box base 400, the top cover 500 and the bottom cover 600 which cover the top area and the bottom area of the box base 400, and is made of the non-magnetic, synthetic resins.

In the box base 400, the winding terminals 1*a*, 1*b*, 12*a*, 12*b* and the contact terminals 2*a*–11*a*, 2*b*–11*b* are set in dual-in-line. The H shaped yoke 200 is placed at the top surface of the box base 400. The armature 300 is set to secure the free rotation supported by the shaft catches placed on both sides of the box base 400. Resin-filled apertures 202 provide support for base 400.

In the above embodiment, a part of the core 100 is molded of synthetic resins, and the same mold resins form the shaft catches 150. The core 100 is placed on the box base 400 in the condition where its shaft catches 150 are fitted into the aforesaid shaft catches 410. The winding 110 is connected with the connections 1*a*', 1*b*', 12*a*', 12*b*' extended from the winding terminals 1*a*, 1*b*, 12*a*, 12*b*.

Between the box base 400 and the bottom cover 600, plural number of the flat spring movable contact pieces 710, 720 are placed, and by these movable contact pieces 710, 720, the contact terminals 2*a* through 11*a* on one side make the electrical make-break with the contact terminals 2*b* through 11*b* on the other side. The movable contact pieces 710, 720 are activated by said rotation of the armature 300. Therefore, the plural number of the projections (the projection 321 in FIG. 11 is one of them), and the projection 321 enters downwardly into the slit 420 formed on the bottom surface of the box base 400, and touches and moves the movable contact members 710 or 720. To explain in detail the area shown in FIG. 11, the base end of the movable contact member 710 is fixed to the contact area 4*b*' of the contact terminal 4*b* and the free end side of the movable contact member 710 is in make-break free to the contact area 4*a*' of the contact terminal 4*a*, and at the same time, it is constantly despressed by its elastic strength so as to stay contact with the contact area 4*a*'. In foregoing embodiment, when the armature 300 is rotating in arrow P direction, the projection 321 depresses downwardly the free end side of the movable contact member 710, and the movable contact member 710 disengages from the contact area 4*a*'. When the armature 300 reverse-rotates in arrow Q direction, the projection 321 disengages from the movable contact member 710, and the movable contact member 710 makes the contact with the contact area 4*a*'. At this time, the other movable contact member 720 is despressed by the projection, undescribed herein, on the opposite side, and the contact circuit including the same contact member 720 becomes off. Thus, if a polarized relay is configurated by utilizing the polarized electromagnetic device of the present invention, the whole composition is made extremely flat.

Since the present configuration can be essentially secured with the construction that the core 100 and the yoke 200 are positioned separately and spaced-apart in the corresponding placement, its assemblage is brought forth very easily and the automated assemblage can easily be utilized.

Still further, the explanation is given on the seventh embodiment of the polarized electromagnetic device of the present invention accordingly with FIG. 12 and FIG. 13. In this device of the seventh embodiment, the core 100 and the yoke 200 are composed in as same letter H shape as the second embodiment, and the placement of two permanent magnets 311, 312 housed in the armature 300 are different from the second embodiment. Two permanent magnets 311, 312 are set in intercrossing against the rotation central shaft 330 of the armature 300, and each center is conformed to the shaft 330, and the poles of the permanent magnets 311, 312 are mutually in opposite. And both poles of one permanent magnet 311 correspond to two pole pieces 121, 122, showing the same pole, of the core 100, while both poles of the other permanent magnet 312 correspond to two pole pieces 131, 132, showing the opposite said pole of the core 100.

In the said embodiment, when the armature 300 rotates in arrow P direction, S pole of one permanent magnet 311 makes contact with the pole pieces 122, and N pole makes contact with the facing-surface 221 of the yoke 200, while N pole of the other permanent magnet 312 makes contact with the pole piece 132, and S pole makes contact with the facing-surface 231 of the yoke 200. In this condition, as described by the solid line $\phi$PM of FIG. 13, the magnetic fluxes of two permanent magnets 311, 312 are connected to create the chain of the closed magnetic circuit, and the armature 300 is maintained in this state. Then, the winding 110 is excited by the current in predetermined direction so as to create the magnetic flux $\phi$EM which flows through the core 100 and the yoke 200 in the opposite direction against the magnetic flux $\phi$PM created by said permanent 311, 312. Then, the magnetic flux $\phi$PM is cancelled by the magnetic flux $\phi$EM, and the armature 300 rotates in arrow Q direction, namely, the direction of the closed magnetic circuit which is in conformity to the magnetic flux $\phi$EM, shown by the dotted line $\phi$PM1, created by the permanent magnets 311, 312. And if the contacts of the permanent magnets 311, 312 with the core 100 and the yoke 200 become opposite to the afore description, the armature 300 is maintained in the same state, even when the exciting current to the winding 110 is cut off.

It is apparent from the construction that it is possible to configure a flat polarized relay shown in FIG. 10, according to the seventh embodiment.

The eighth embodiment of the polarized electromagnetic device of the present invention is explained accordingly with FIG. 14. In this embodiment, the core 100 is formed in letter U shape, and on the upper side and the lower side of its pole pieces 120, 130, the yoke 201 and the yoke 202 are respectively positioned spaced-apart. In the armature 300, the permanent magnet 311 positioned inbetween the yoke 201 and the pole pieces 120, 130, and the permanent magnet 312 positioned inbetween the yoke 202 and the pole pieces 120, 130, are included. The directions of the poles of the both permanent magnet 311, 312, are mutually in opposite. The armature 300 rotates freely about the axis 330 in arrow P-Q directions, and can secure two stabilized states: the first stabilized state when the permanent magnet 311 makes contact with the yoke 201 and simultaneously the permanent magnet 312, makes contact with the core 100; and the second stabilized state when the permanent magnet 311 makes contact with the core 100 and the simultaneously the permanent magnet 312 makes contact with the yoke 202.

The ninth embodiment of the polarized electromagnetic device of the present invention is explained accordingly with FIG. 15. In this embodiment, the core 100 is formed in a flat letter E shape, and when the winding 110 is excited, the central pole piece 120 and the pole pieces 131, 132 on either side show respectively the opposite magnetic poles. The yoke is formed in a straight board shape which has the facing-surfaces 220, 231, 232 to the pole pieces 120, 131, 132. Two permanent magnets 311 and 312 included in the armature 300 are positioned straight-lined; the directions of the magnetic poles of both said permanent magnets are in conformity. The armature 300 is of the construction rotates freely at the shaft 330, which runs through the very centers of both said permanent magnets 311, 312 and intercrosses with them, in arrow P-Q directions.

Since widely different embodiments of this invention may be made without departing from the spirit and scope thereof, it is to be understood that the invention is not limited to the specific embodiments thereof except as defined in the appended claims.

What is claimed is:

1. A polarized electromagnetic device comprising:

a core made of a soft-magnetic material and wound with a magnetizing winding for generating magnetic flux in a first direction in response to excitation by a first voltage polarity and for generating magnetic flux in a second direction opposite to said first direction in response to excitation by a second voltage polarity opposite said first voltage polarity, said core including a pair of separated pole pieces;

a yoke, made of the same material as said core, being separated from said core to define an air gap, said yoke having facing-surfaces opposingly disposed to said pair of pole pieces of said core through said air gap so as to be magnetically connected with said core through said air gap to form a first closed magnetic path of magnetic flux generated by said magnetizing winding; and an armature including a body having a permanent magnet, both magnetic poles of said permanent magnet being disposed in said air gap so as to form second and third closed magnetic paths with said core through said air gap and with said yoke through said air gap, respectively, said armature mounted so as to pivotally move said both magnetic poles between said pole pieces of said core and said facing-surfaces of said yoke; wherein when said magnetizing winding is excited to generate magnetic flux in said first direction, the magnetic flux in said first closed magnetic path opposes magnetic flux in said third closed path so as to allow said magnetic poles of said permanent magnet to be attracted to said core, and when said magnetizing winding is excited to generate magnetic flux in said second direction, the magnetic flux in said first closed magnetic path opposes magnetic flux in said second closed path so as to allow said magnetic poles of said permanent magnet to be attracted to said yoke.

2. A polarized electromagnetic device according to claim 1, wherein said core and said yoke are substantially planar in shape, and fixed relative to one another in a spaced-apart, parallel relationship, and wherein said armature includes means for mounting said permanent magnet in non-magnetic material, said armature being constructed in a rectangular planar shape, and including pivot means defining a pivot axis to permit pivotal movement thereof between said core and said yoke.

3. A polarized electromagnetic device according to claim 1 wherein said armature includes a pair of rod-shaped permanent magnets, wherein said pair of rod-shaped magnets are disposed parallel to the pivot axis of said armature and positioned symmetrically about said axis, and wherein the polarity of said pair of rod-shaped permanent magnets is mutually opposite to one another, the magnetic poles in either of said pair of rod-shaped permanent magnets respectively corresponding to both said pole pieces of said core.

4. A polarized electromagnetic device according to claim 1 wherein said armature includes a pair of rod-shaped permanent magnets, wherein said pair of rod-shaped permanent magnets respectively intercrossing perpendicularly with said pivot axis of said armature, and wherein each center of each said pair of rod-shaped permanent magnets being intersected by said axis, and wherein the polarity of said pair of rod-shaped permanent magnets is mutually opposite to one another, one of said pair of rod-shaped permanent magnets corresponding to the magnetic pole of one of said pair of pole pieces of said core, while the other of said pair of rod-shaped permanent magnets corresponds to the magnetic pole of the other of said pair of pole pieces of said core.

* * * * *